United States Patent [19]

Chrysostome

[11] Patent Number: 4,471,723

[45] Date of Patent: Sep. 18, 1984

[54] HEAT RECOVERY METHOD AND INSTALLATION, PARTICULARLY FOR COOLING ASH

[75] Inventor: Gérard Chrysostome, Torcy, France

[73] Assignee: Creusot-Loire, Paris, France

[21] Appl. No.: 443,817

[22] Filed: Nov. 22, 1982

[30] Foreign Application Priority Data

Nov. 27, 1981 [FR] France ..... 81 22228

[51] Int. Cl.[3] ..... F22B 1/02

[52] U.S. Cl. ..... 122/4 D; 110/245; 122/7 R

[58] Field of Search ..... 122/20 B, 4 D, 7 R, 122/420, 421; 110/245

[56] References Cited

U.S. PATENT DOCUMENTS

| | | | |
|---|---|---|---|
| 4,111,158 | 9/1978 | Rah et al. | 122/4 D |
| 4,159,682 | 7/1979 | Fitch et al. | 110/245 |
| 4,196,676 | 4/1980 | Brown et al. | 110/245 |
| 4,349,969 | 9/1982 | Stewart et al. | 122/4 D |
| 4,355,601 | 10/1982 | Hattiangadi | 122/7 R |

*Primary Examiner*—Henry C. Yuen

*Attorney, Agent, or Firm*—Pollock, Vande Sande & Priddy

[57] ABSTRACT

The invention relates to a recovery method and installation for the heat contained in a solid substance, occurring in divided form and more especially in ash produced by a fluidized bed combustion furnace. According to the invention the coarsest ash is removed through a purging outlet from the fluidized bed, the finest ash is separated from the smoke and the ash is cooled in two apparatuses adapted to the granulometry, one to the finest ash and the other to the coarsest ash.

1 Claim, 1 Drawing Figure

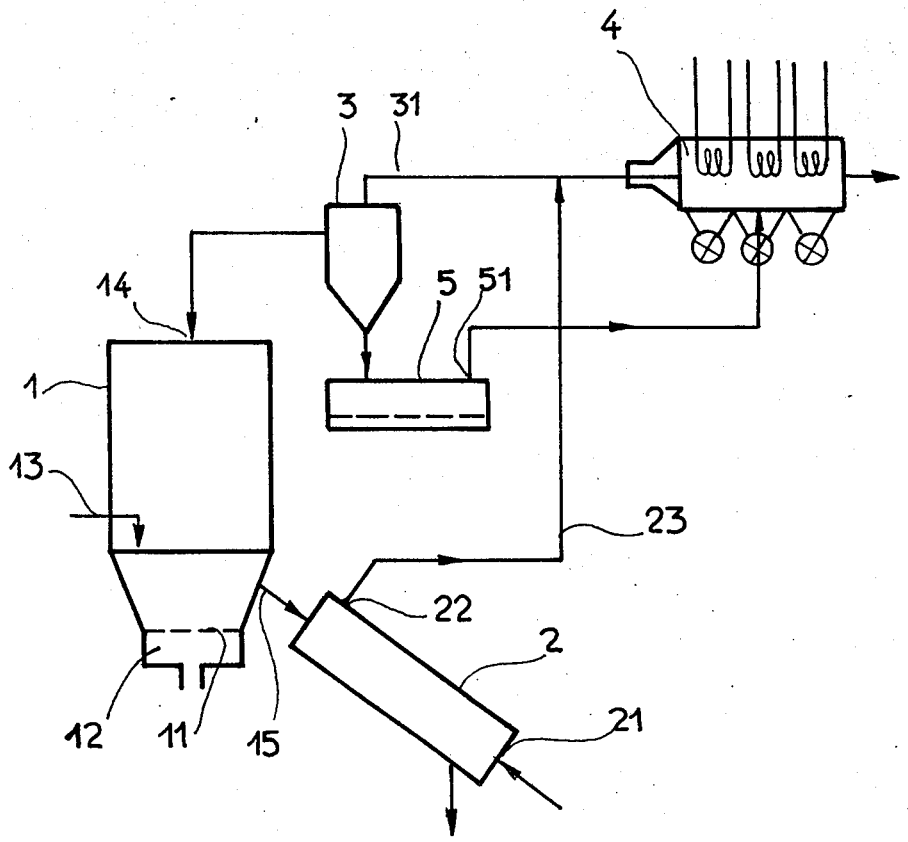
4
3
31
14
5
51
1
13
23
22
2
21
12
11
15

HEAT RECOVERY METHOD AND INSTALLATION, PARTICULARLY FOR COOLING ASH

BACKGROUND OF THE INVENTION

The invention relates to a recovery method and installation for the heat contained in a solid body occurring in divided form, and applies more especially to the cooling of the ash from lean fuels.

Lean fuels like bony coal and oil shale have an ash content higher than 50%. This ash, which must be periodically removed, contains a quantity of heat which represents a considerable fraction of the energy initially contained in the fuel, of the order of 25 to 50%. It is therefore advantageous to recover this heat in cooling equipment in which the ash is cooled by a gas, generally air, which is thus heated and can itself serve in a recovery circuit, such as a boiler.

However, the granulometric spectrum of the ash is generally rather extended, and it has been observed that the yield of cooling equipment of different types was optimal only when the latter were supplied by substances occurring within a rather precise granulometric range.

SUMMARY OF THE INVENTION

To improve this yield, according to the invention, the substances are separated into several portions, each granulometry corresponding to a predetermined range, and each portion is passed into a cooling apparatus specially adapted to its granulometry.

This method finds particularly advantageous application in the case of lean fuels which are burnt generally in a fluidized bed, since the latter enables stable combustion and is satisfied by coarse grinding, for example, between 0 and 10 mm.

The fluidized bed has the peculiarity of itself producing, in the course of combustion, a separation of the ash produced according to its granulometry. In fact, the finest ash, for example smaller than 0.5 mm, is entrained by the rising gas flow removed with the smoke, whereas the ash of coarsest granulometry, for example comprised between 0.5 and 10 mm, remains in the fluidized bed. Moreover, it is necessary to proceed with continuous or discontinuous purging through an outlet placed at the height of the fluidized bed to preserve a substantially constant volume in the latter.

It is an object of the invention to profit from this separation effected by said fluidized bed itself to adapt the cooling method to the granulometry of the ash and to use coolers at their optimal efficiency.

To this end, the coarsest ash is removed through the purging outlet from the fluidized bed, the finest ash is separated from the smoke escaping from the furnace, and the two portions of ash thus collected are cooled in two cooling apparatuses each adapted to the granulometry, one to the finest ash and the other to the coarsest ash.

In a preferred embodiment, the coarsest ash is cooled by counter-current air circulation and the finest ash in a fluidized bed, and the air heated by the coarsest ash is mixed with the smoke emerging from the furnace after separation of the fine ash, said smoke and the air heated by the fine ash being then introduced at two different points of a circuit for using the heat of the thus-heated gases.

According to another aspect of the invention, there is provided an installation for practising the method according to the invention which comprises therefore two cooling apparatuses, one supplied by the coarsest ash removed through the purging outlet and the other supplied by the finest ash taken up by a separator from the smoke emerging from the furnace.

BRIEF DESCRIPTION OF THE DRAWING

The accompanying FIGURE represents diagramatically, by way of example, such an installation.

DETAILED DESCRIPTION

The installation shown in the FIGURE comprises a fluidized bed furnace constituted by an enclosure 1 provided at its lower part with a grid 11 bounding a fluidization gas admission chamber 12. The fuel supplied through an inlet 13 burns in the fluidized bed formed above the grid 11 and the smoke is removed through the chimney 14. An outlet 15 placed at the height of the fluidized bed and constructed conventionally enables purging to be carried out by removing the coarsest ash, whereas the finest ash escapes with the smoke through the chimney 14.

The ash in passing out through the purge 15 supplies a cooler 2 constituted, for example, by an inclined rotary drum in which the ash descends, in counter-current to the cooling gas so that air which is introduced cold at 21, flows in reverse direction to the solid material and emerges at 22 at a temperature of the order of 800° C.

The smoke which escapes through the chimney 14 has a temperature of about 900° C., passes first into a static separator 3, for example a cyclone, and is led through a gas evacuation pipe 31 to a utilization circuit, for example, a recovery boiler 4. The finest ash drawn into the chimney 14 by the smoke is therefore collected at the lower portion of the separator 3, at a temperature of about 900° C. and supplies a cooler adapted to its granulometry, for example, a fluidized bed 5. The latter is supplied with cold air which is distributed beneath the grid, passes through the latter at a low speed and emerges at 51 at at temperature of about 500°.

The air at 800° passing out at 22 from the counter-current cooler 2 is removed by a pipe 23 which opens into the pipe 31 upstream of the boiler 4 which is thus supplied by the mixture which flows inside the boiler being cooled, for example, on water-circulating bundles for the production of steam. The air at 500° emerging at 51 from the cooler 5 can hence be introduced further downstream into the recovery boiler, in a zone where the smoke has already been cooled to a temperature of about 500°.

By means of such an installation, each of the two coolers operates for the granulometry to which it is adapted and the hot gases produced are used under optimum conditions.

The installation which has just been described therefore permits a poor fuel to be processed in a fluidized bed without risking the loss in the ash of a large portion of the heat produced.

The invention is not limited to the embodiment which has just been described. In particular, it would be possible to use other types of coolers each adapted to the granulometry of the cooled ashes.

I claim:

1. Installation for the recovery of the heat produced in a fluidized-bed combustion furnace, comprising:

(a) a combustion furnace comprising a supply inlet for combustible material, means for forming a fluidized bed for combustion producing coarse ash and fine ash, and a purging outlet for the evacuation of the coarsest ash;

(b) a separator connected to said combustion furnace by a circuit for evacuating smoke emerging from said furnace and fine ash entrained with said smoke and recovered in said separator;

(c) a heat recovery device connected to said separator by a smoke evacuating conduit;

(d) a first cooling means supplied with said coarsest ash evacuated from said fluidized bed through said purging outlet, said first cooling means comprising a counter-current cooler traversed by a gas flowing in reverse direction from the coarsest ash and evacuated after heating through a conduit debouching into said conduit for evacuation of the smoke from said separator, upstream of said recovery device; and (e) a second cooling means supplied with the finest ash recovered at an outlet of said separator, said second cooling means comprising a fluidized-bed cooler supplied by a gas in which said finest ash is fluidized, said gas being evacuated through a conduit at the interior of said heat recovery device in a zone where a mixture of smoke coming from said separator and said gas coming from said first cooling means has already been cooled to a temperature of the same order as the temperature of the gases emerging from said second cooling means.

* * * * *